US010137338B2

(12) United States Patent
Nakamura et al.

(10) Patent No.: US 10,137,338 B2
(45) Date of Patent: Nov. 27, 2018

(54) GOLF CLUB HEAD

(71) Applicant: SUMITOMO RUBBER INDUSTRIES, LTD., Kobe-shi, Hyogo (JP)

(72) Inventors: Takashi Nakamura, Kobe (JP); Daisuke Kohno, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/498,668

(22) Filed: Apr. 27, 2017

(65) Prior Publication Data

US 2017/0312590 A1 Nov. 2, 2017

(30) Foreign Application Priority Data

Apr. 28, 2016 (JP) ..... 2016-090625

(51) Int. Cl.
*A63B 53/04* (2015.01)

(52) U.S. Cl.
CPC .... *A63B 53/047* (2013.01); *A63B 2053/0416* (2013.01); *A63B 2053/0433* (2013.01); *A63B 2053/0491* (2013.01)

(58) Field of Classification Search
CPC ..... A63B 53/047; A63B 5053/0491; A63B 2053/0416
See application file for complete search history.

(56) References Cited

U.S. PATENT DOCUMENTS

| | | | | |
|---|---|---|---|---|
| 7,396,299 | B2 * | 7/2008 | Nicolette | A63B 53/047 473/334 |
| 8,449,405 | B2 | 5/2013 | Jertson et al. | |
| 9,017,186 | B2 * | 4/2015 | Jertson | A63B 53/04 29/428 |

* cited by examiner

*Primary Examiner* — Michael Dennis
(74) *Attorney, Agent, or Firm* — Birch, Stewart, Kolasch & Birch, LLP

(57) ABSTRACT

A golf club head comprises a head main body, a weight member and a fixing member. The head main body is provided with a concave portion concaved from an outer surface of a finished shape of the golf club head. A specific gravity of the weight member is larger than a specific gravity of the head main body and larger than a specific gravity of the fixing member. The weight member is at least partially disposed in the concave portion. The fixing member is fixed to the concave portion so as to cover at least a part of the weight member from outside of the golf club head. The fixing member is provided with a through hole having an opening located in the above-said outer surface, and a part of the weight member is disposed in the through hole.

20 Claims, 14 Drawing Sheets

GOLF CLUB HEAD

TECHNICAL FIELD

The present invention relates to a golf club head, more particularly to a structure relating to a weight member capable of increasing the degree of freedom in designing the center of gravity of the head.

BACKGROUND ART

U.S. Pat. No. 8,449,405 (Patent Document 1) and U.S. Pat. No. 9,017,186 (Patent Document 2) disclose golf club heads each comprising a head main body and a weight member fixed thereto, wherein the weight member comprises a first weight component having a relatively high specific gravity, and a second weight component having a lower specific gravity than the first weight component.

The first weight component having a higher specific gravity has a low weldability with the head main body, whereas the second weight component having a lower specific gravity has a better weldability with the head main body than the first weight component. Therefore, in Patent Documents 1 and 2, it is proposed that, firstly, the weight member is prepared by fixing the first weight component to the second weight component, and then by welding the second weight component with the head main body, the weight member is fixed to the head main body.

SUMMARY OF THE INVENTION

Problems to be Solved by the Invention

In the golf club heads disclosed in the above Patent Documents 1 and 2, due to the structure of the weight member, the productivity of the golf club heads is liable to decrease. Further, the second weight component is liable to come off the first weight component. Thus, there is room for improvement in durability.

The present invention was made in view of the above, and a primary object thereof is to provide a golf club head, in which the degree of freedom in designing the center of gravity of the head is increased, without lowering the durability and productivity.

According to the present invention, a golf club head comprises a head main body, a weight member and a fixing member, wherein the head main body is provided with a concave portion concaved from an outer surface having a finished shape of the head, a specific gravity of the weight member is larger than a specific gravity of the head main body and larger than a specific gravity of the fixing member, the weight member is at least partially disposed in the concave portion, the fixing member is fixed to the concave portion so that at least a part of the weight member is covered with the fixing member from outside of the golf club head, the fixing member is provided with a through hole having an opening located in the above-said outer surface, and a part of the weight member is disposed in the through hole.

Therefore, according to the present invention, the weight member is fixed to the head main body by the fixing member fixed to the concave portion so as to cover at least a part of the weight member from outside of the golf club head.

Therefore, the fixing of the weight member becomes easy, and the productivity can be improved.

Further, as the weight member is covered with the fixing member from outside of the golf club head, the weight member can be prevented from coming off the head main body, and the durability of the golf club head can be improved.

Furthermore, as the weight member is partially disposed in the through hole of the fixing member having the opening in the outer surface of the golf club head, it is possible to shift the weight toward the opening. Therefor, by providing the opening in a desired position, it is possible to shift the position of the center of gravity of the head toward the opening. Thus, the degree of freedom in designing the center of gravity of the head is increased.

Further, the golf club head according to the present invention may have the following features:

(1) a specific gravity of the weight member is larger than a specific gravity of the fixing member which is larger than a specific gravity of the head main body;

(2) the head main body has a better weldability with the fixing member than with the weight member, and the head main body is fixed to the fixing member by welding, but not welded with the weight member;

(3) the above-said opening of the fixing member is provided in a back side of the golf club head;

(4) the above-said opening of the fixing member is provided in a sole side of the golf club head;

(5) the above-said said opening of the fixing member is provided in at least one of a toe side part and a heel side part of the golf club head;

(6) the weight member is disposed in a toe side part or alternatively a heel side part of the golf club head;

(7) the weight member is disposed in each of a toe side part and a heel side part of the golf club head separately;

(8) the above-said part of the weight member disposed in the through hole protrudes out of the fixing member from the opening;

(9) the above-said opening of the fixing member extends in a front-back direction of the golf club head on a sole side thereof, and the weight member protrudes out of the fixing member from the above-said opening and extends in the front-back direction of the golf club head;

(10) an outer surface of the fixing member excepting the above-said opening forms a part of the above-said outer surface having the finished shape of the head, and an inner surface of the fixing member and a surface of the concave portion define a space accommodating the weight member;

(11) the above-said opening has a shape elongated in a toe-heel direction of the golf club head;

(12) the weight member protrudes out of the fixing member from the above-said opening so that the protruding part extends in the toe-heel direction;

(13) the above-said opening has a shape elongated in a toe-heel direction of the golf club head;

(14) the above-said opening has a shape elongated in a front-back direction of the golf club head so that the opening extend from a back side to a sole side of the golf club head;

(15) each of the weight member and the fixing member is made of an alloy comprising tungsten, nickel and iron, and the alloy of the fixing member has a less content of tungsten and a more content of iron in terms of percentage than the alloy of the weight member;

(16) the head main body comprises a face plate and a face plate support to which a peripheral portion of the face plate is fixed, the above-said concave portion is provided on the face plate support, the face plate is made of a titanium alloy, and the face plate support is made of an iron-based alloy;

(17) the head main body comprises a face plate and a face plate support to which a peripheral portion of the face plate is fixed, the above-said concave portion is provided on the face plate support, the specific gravity of the face plate is not greater than 4.5, the specific gravity of the face plate support is not less than 7.0, the specific gravity of the weight member is not less than 10 and not greater than 18.5, and the specific gravity of the fixing member is not less than 8 and not greater than 10.

DESCRIPTION OF THE PREFERRED EMBODIMENTS

The present invention can be applied to various golf club heads such as iron-type golf club heads, wood-type golf club heads, utility-type golf club heads and putter-type golf club heads.

Taking an iron-type golf club head as an example, embodiments of the present invention will now be described in detail in conjunction with accompanying drawings.

Unless otherwise noted, the description will be made given that the golf club head 1 is in its standard state.

Figure 14:
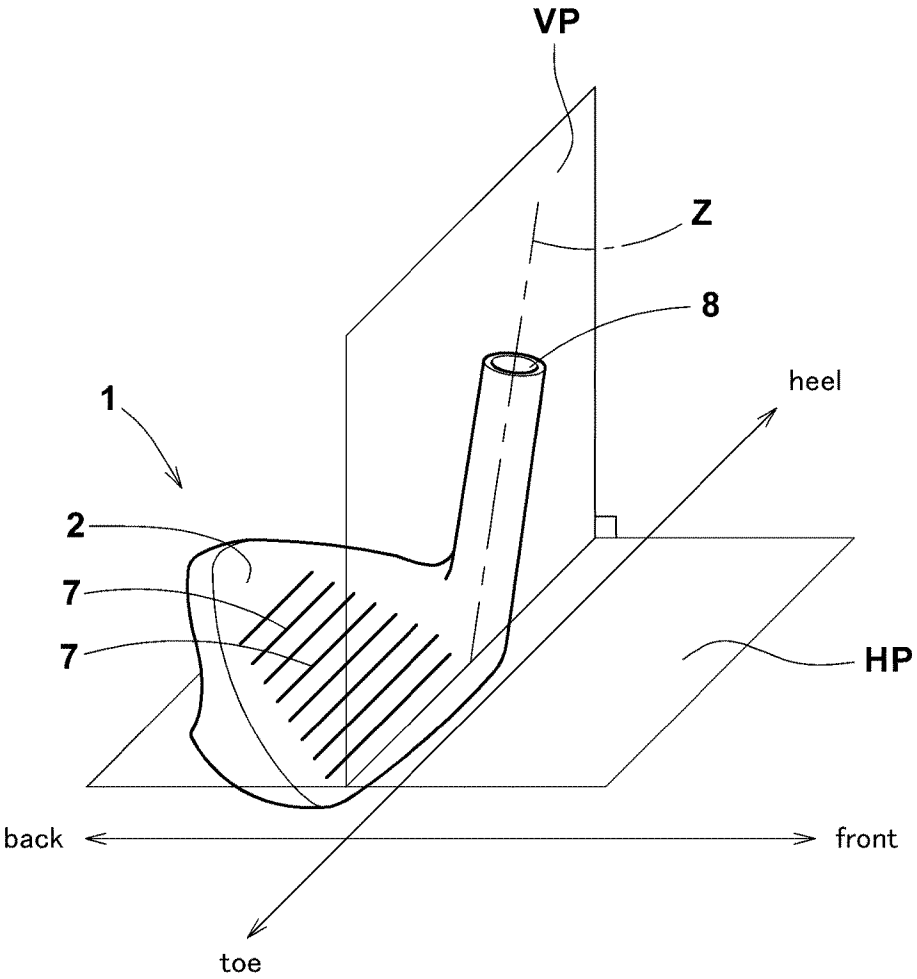
FIG. 14 is a perspective diagram for explaining the standard state of the golf club head.

The "standard state" is, as shown in FIG. 14, a state of the golf club head 1 which is set on a horizontal plane HP such that the center line Z of a shaft insertion hole 8 of the golf club head (corresponding to the club shaft center line) is positioned in a vertical plane VP perpendicular to the horizontal plane HP, and score lines 7 formed in a face 2 become in parallel with the horizontal plane HP, and in parallel with the vertical plane VP.

The term "up-down direction" means a direction perpendicular to the horizontal plane HP.

The term "toe-heel direction" means a direction in parallel with the horizontal plane HP and in parallel with the vertical plane VP.

The term "front-back direction" means a direction in parallel with the horizontal plane HP and perpendicular to the vertical plane VP.

Incidentally, as shown in FIG. 14, "front" of the golf club head 1 means a side of the face 2 which strikes a golf ball, and "rear" means the opposite side thereto. In view of the custom of the golf industry, "rear" and "rear side" of the golf club head may be referred to as "back" and "back side", respectively. Further, "up" with regard to the golf club head 1 is defined as a direction away from the horizontal plane HP or a position distant from the horizontal plane HP, relatively. On the other hand, "low" with regard to the golf club head 1 is defined as a direction closer to the horizontal plane HP or a position closer to the horizontal plane HP, relatively. In view of the custom of the golf industry, a "lower surface" of the golf club head may be referred to as a "bottom surface".

Further, the expression "forward tilted state" used hereinafter means a state of the golf club head 1 in which the golf club head 1 in the standard state is tilted forward around a horizontal axis extending in parallel with both the horizontal plane HP and the standard vertical plane VP so that the face 2 becomes in parallel with the vertical plane VP.

In FIGS. 1-4 showing an embodiment of the present invention, the golf club head 1 is an iron-type golf club head having a typical iron-type shape and comprising a face 2, a top 3, a sole 4, a toe 5 and a hosel 6.

Figure 1:
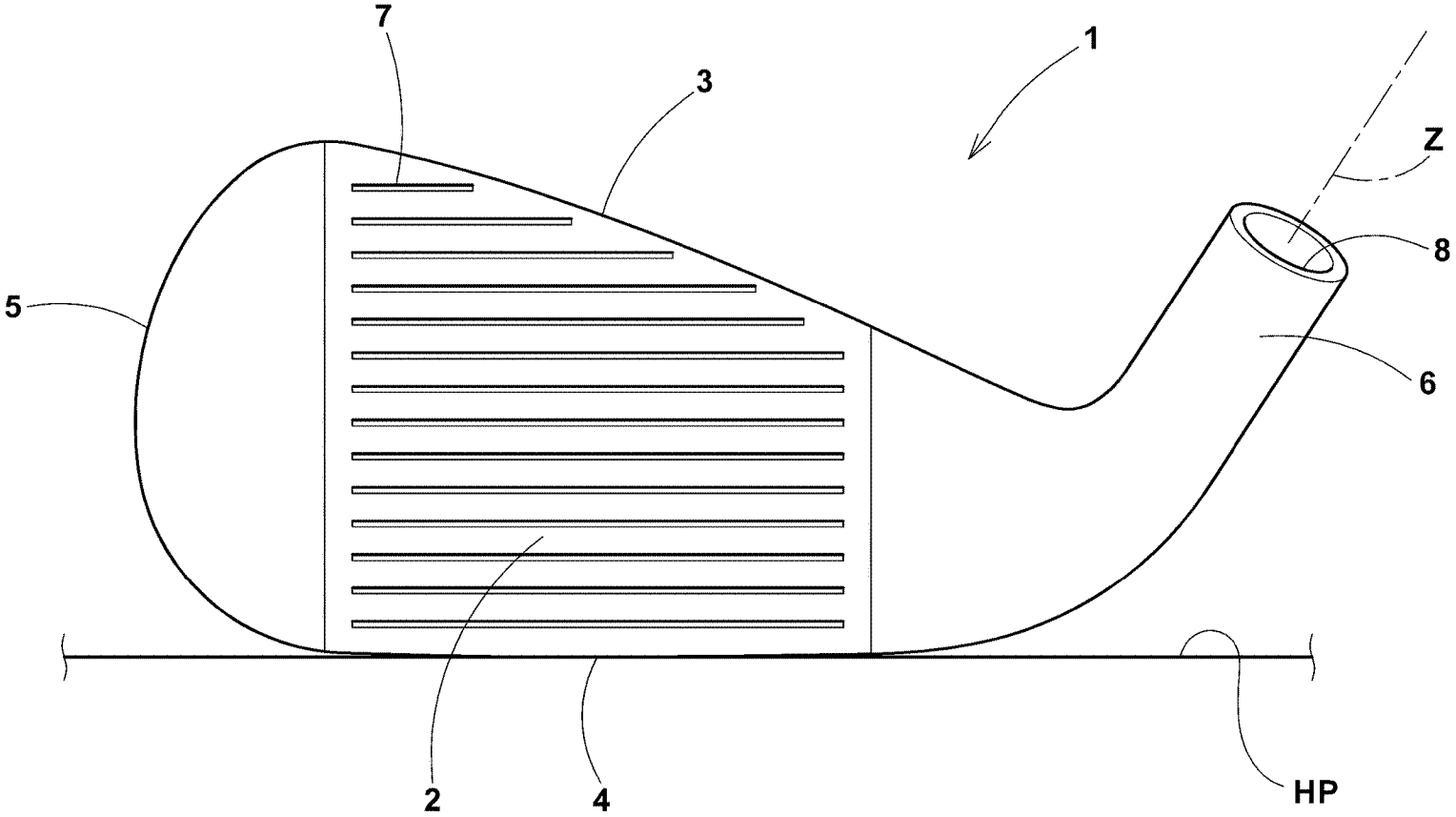
FIG. 1 is a front view of a golf club head as an embodiment of the present invention.
Figure 2:
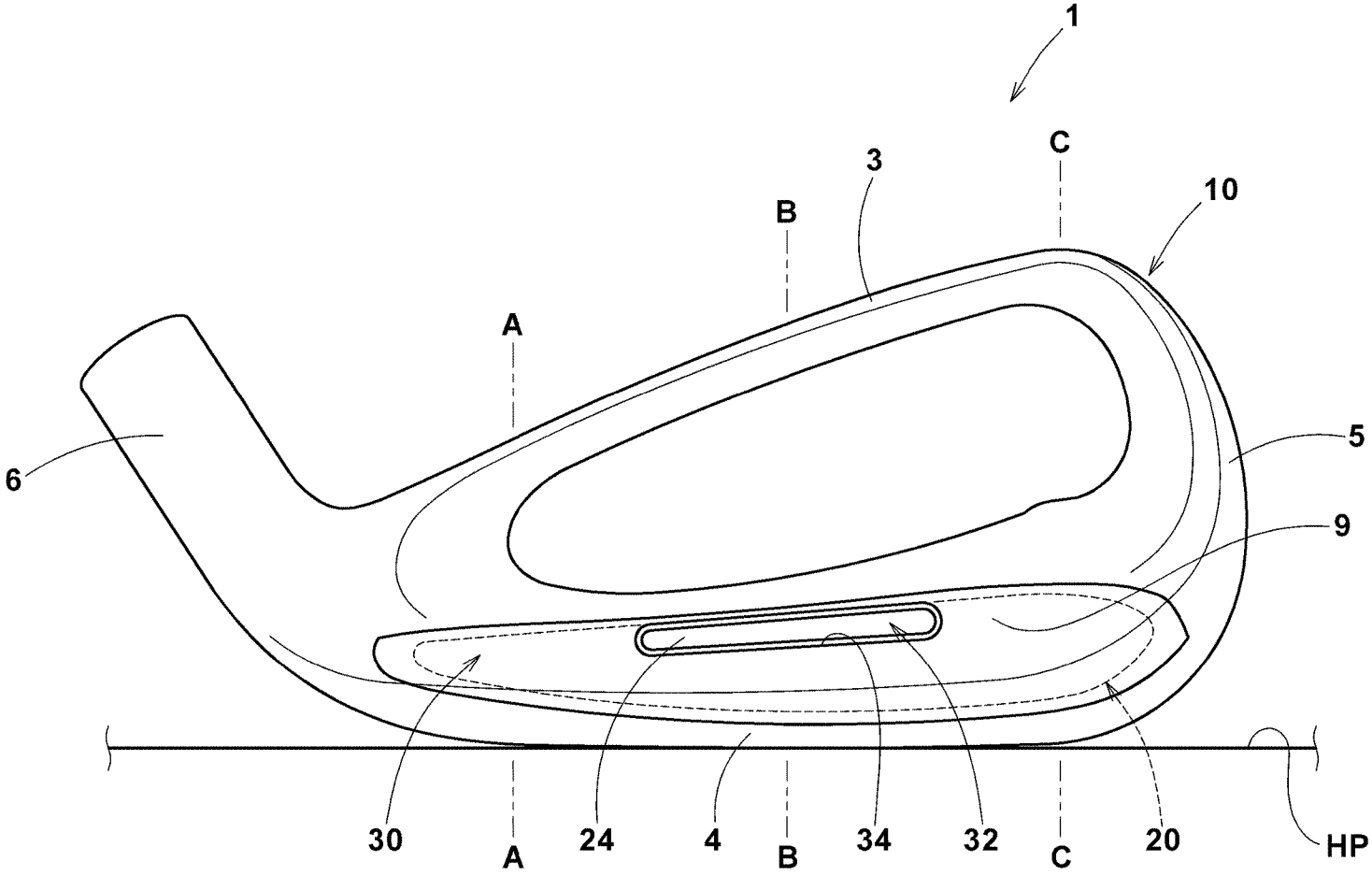
FIG. 2 is a rear view of the golf club head.
Figure 3A:
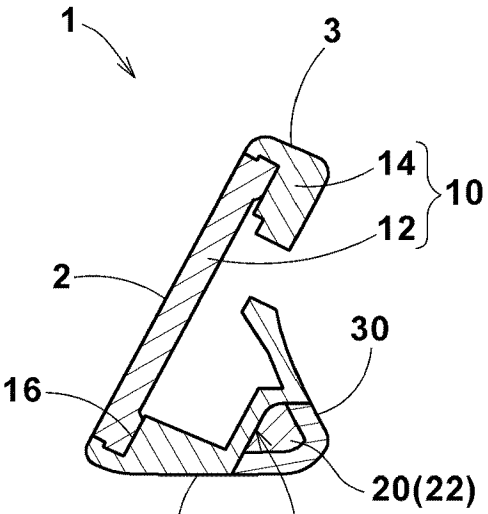
FIGS. 3(A), 3(B) and 3(C) are cross-sectional views of the golf club head taken along line A-A, line B-B and line C-C, respectively.
Figure 3B:
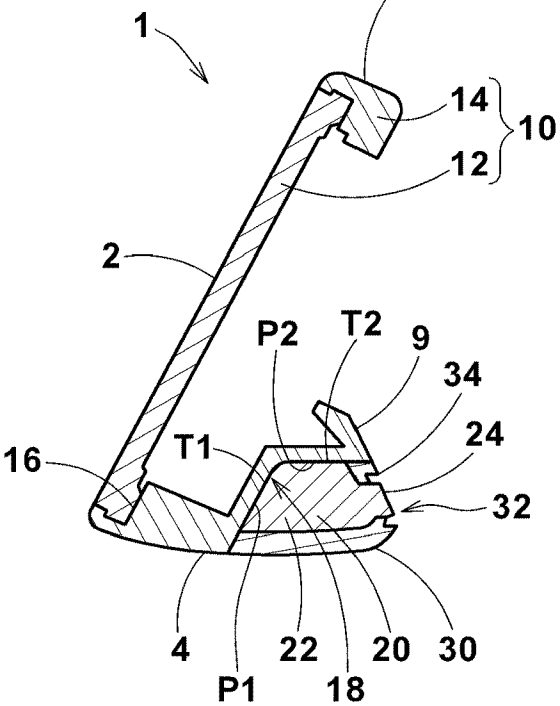
Figure 3C:
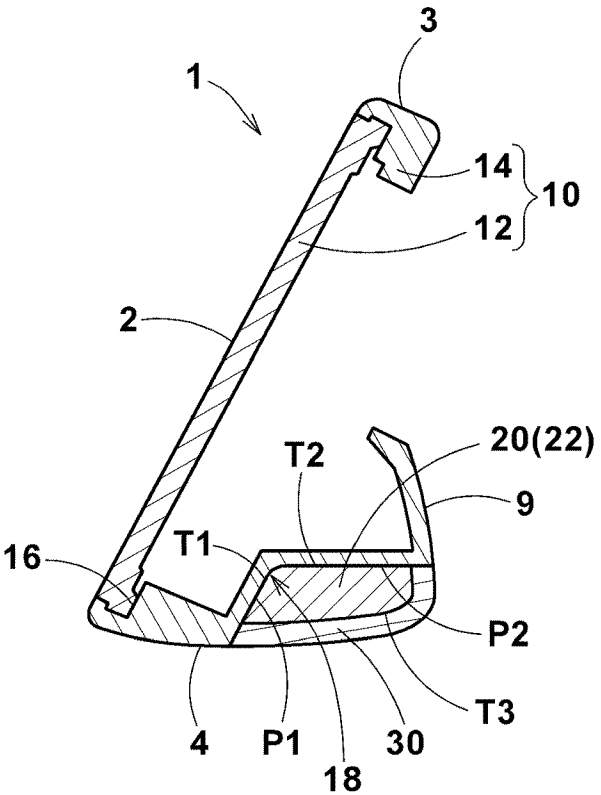

FIGS. 1 and 2 show the front view and rear view of the head 1 in the forward tilted state. FIGS. 3(A)-3(C) show the cross-sectional views of the head 1 in the standard state.

The hosel 6 is a part provided with a shaft insertion hole 8 into which a tip end of a golf club shaft (not shown) is attached, and formed as a tubular upwardly protruding part for example. Incidentally, the center line Z of the shaft insertion hole 8 coincides with the center line of the golf club shaft.

The face 2 is a substantially flat face for striking a golf ball. The face 2 may be provided with impact area markings. For example, the face 2 in this embodiment is provided with score lines 7 in order to increase friction on the golf ball surface.

The top 3 is an upper surface portion of the golf club head 1 extending backward from an upper edge of the face 2.

The sole 4 is a bottom surface portion of the golf club head 1 extending backward from a lower edge of the face 2.

The toe 5 is a portion located most distant from the hosel 6 and connecting smoothly between the top 3 and the sole 4.

Figure 4:
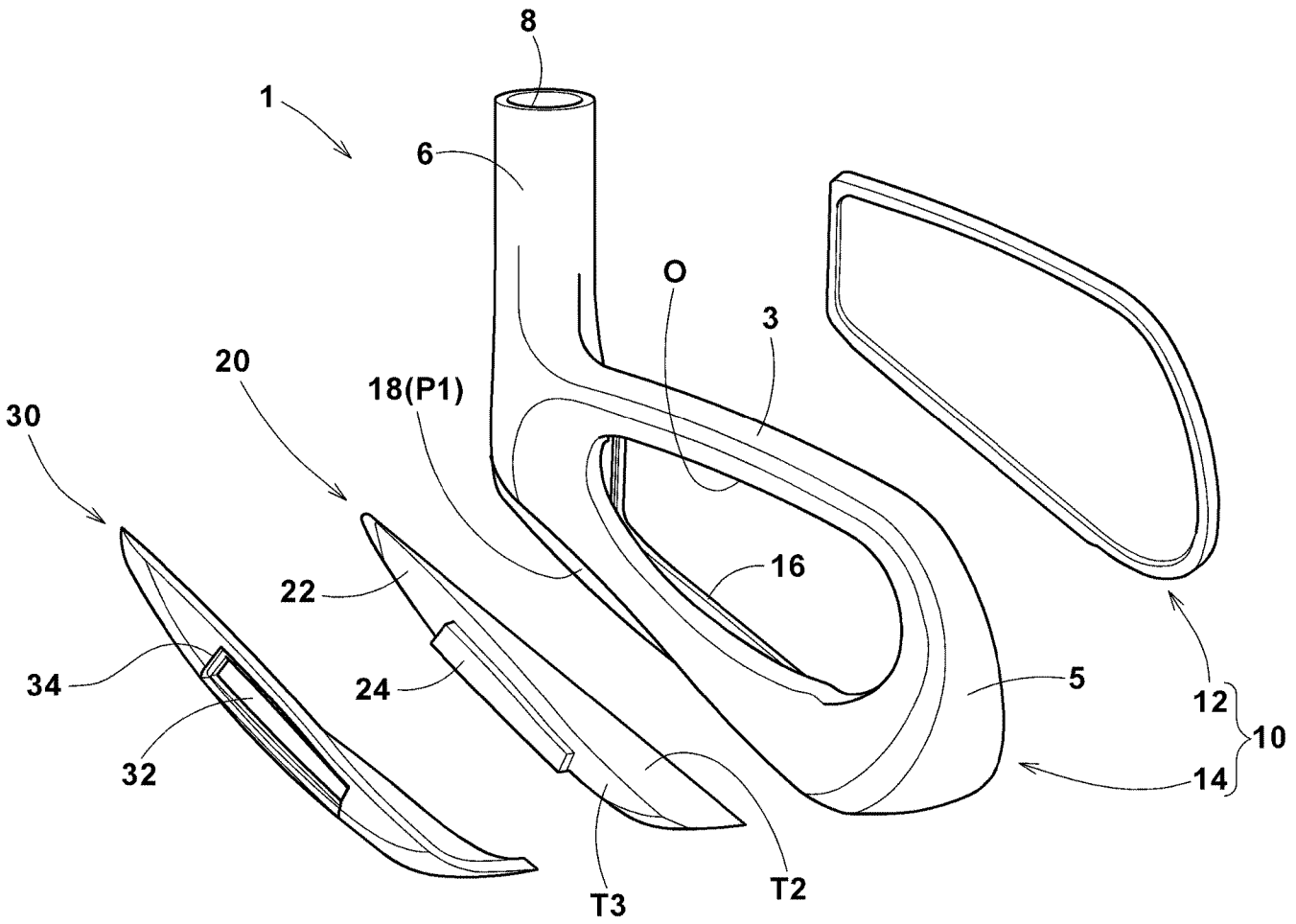
FIG. 4 is an exploded perspective view of the golf club head showing an example of the component parts thereof.

The golf club head 1 in this embodiment is composed of a head main body 10, a weight member 20, and a fixing member 30 as shown in FIG. 3 and FIG. 4.

The head main body 10 forms a major part of the golf club head 1 and includes the face 2, the top 3, the sole 4, the toe 5 and the hosel 6 in this embodiment.

The head main body 10 is made of a metal material of metal materials, for example.

Preferably, the head main body 10 comprises a face plate 12 and a face plate support 14 as shown in FIG. 4. Preferably, the face plate 12 and the face plate support 14 are made of different metal materials.

The face plate 12 is made of a metal material of which specific gravity is, for example, smallest among the metal materials used for the golf club head 1.

For the metal material of such face plate 12, a titanium alloy having a specific gravity of not greater than 4.5 and being excellent in the specific strength can be suitably used in particular. Thereby, it is possible that the center of gravity of the golf club head is positioned more backward and lower.

The face plate support 14 is provided with a through hole penetrating in the front-back direction of the head to have an opening O in the front thereof surrounded by the top 3, sole 4 and the toe 5. By the face plate 12 fixedly mounted to the face attaching portion 16, the opening O is closed.

The face plate support 14 in this embodiment is provided with a face attaching portion 16 protruding into the opening O so that a peripheral edge portion of the face plate 12 can be back supported thereby.

In order to firmly fix the face plate 12 and the face plate support 14 together, welding, brazing, adhesives, caulking, etc. can be used alone or in combination.

The above-mentioned hosel 6 and the face plate support 14 are preferably formed integrally from the same material.

As the material of the face plate support 14, iron-based alloys having a basic strength, excellent processability and the like, specifically, stainless steels, carbon steels and the like can be preferably used. The specific gravity of such material is set to be larger than 7.0, preferably not less than 7.5.

When the face plate support 14 is made of a metal material having a higher specific gravity like this which is higher than the face plate 12, it is possible to shift the center of gravity of the golf club head further backward and lower. In this case, the head main body 10 is made of two different materials. However, according to the present invention, the head main body 10 can be made of a single material or three or more kinds of materials.

As the head main body 10 made of a single material, a typical example is a head main body 10 of a single-piece structure in which portions corresponding to the above-mentioned face plate 12 and face plate support 14 are formed integrally, for example by the use of a casting technique, a cutting technique etc. Another example is a head main body 10 having a multi-piece structure in which the face plate 12 and the face plate support 14 made of the same material are fixed together.

As the head main body 10 made of three or more kinds of materials, an example is a head main body 10 in which the face plate support 14 is composed of two or more components made of different materials from each other and also from the face plate 12, and they are fixed together.

According to the present invention, the head main body 10 is provided with a concave portion 18 concaved from an outer surface having the finished shape of the golf club head. In other words, although the concave portion 18 is substantially closed in the finished golf club head, the concave portion 18 is opened and concaved from the outer surface of the finished golf club head.

As shown in FIGS. 3(A), 3(B), 3(C) and 4, in the concave portion 18, the weight member 20 and the fixing member 30 are disposed to form the finished shape of the golf club head. Thus, the concave portion 18 is a hollow formed in the finished outer surface when the weight member 20 and the fixing member 30 are removed.

If a part of the face 2 is formed by the face plate 12, the concave portion 18 is provided in a part other than the face plate 12. In this embodiment, the concave portion 18 is provided in a position other than the face 2. The concave portion 18 is provided in a sole side portion of the head, more specifically, provided in the sole of the face plate support 14.

The concave portion 18 in this embodiment is defined by a first face P1 and a second face P2 intersecting with the first face P1 as shown in FIGS. 3(B) and 3(C).

The first face P1 extends upward from the sole 4.

The second face P2 extends frontward from the back face 9 of the golf club head and intersect with the first face P1 so as to form the surface of the concave portion having an approximately L-shaped cross section.

It is preferred that each of the first face P1 and the second face P2 extends in the toe-heel direction. Thereby, it is possible that the concave portion 18 is formed so as to extend widely in the toe-heel direction on the sole 4 side of the golf club head 1.

Each of the first face P1 and the second face P2 in this embodiment is formed as a substantially flat surface. Further, the first face P1 is substantially parallel with the face 2, and the second face P2 is substantially parallel with the horizontal plane HP.

The weight member 20 is made of a metal material having larger specific gravity than the head main body 10 and the fixing member 30.

Such weight member 20 has a large influence in the position of the center of gravity of the golf club head, therefore, it is possible to have the center of gravity of the golf club head close to the position of the center of gravity of the weight member 20.

If the head main body 10 is made of a single material, the specific gravity of the head main body 10 is the specific gravity of the material. If the head main body 10 is made of a plurality of materials, the specific gravity of such head main body 10 is defined as a weighted average value of the specific gravities of the materials weighted by the respective volumes.

Preferably, the weight member 20 is made of an alloy comprising tungsten, nickel and iron. Such alloy is provided with a high specific gravity by mainly adjusting the content of tungsten. By increasing the ratio of the content of tungsten to the content of iron, the specific gravity can be increased.

The specific gravity of the weight member 20 is preferably set in a range of not less than 10, more preferably not less than 12 but not more than 18.5.

In the weight member 20 increased in the specific gravity like this, as the content of iron is relatively decrease, its weldability with iron-based alloys such as soft iron and stainless steel is decreased.

At least a part of the weight member 20 is disposed in the concave portion 18 of the head main body 10, and, in this embodiment, contacts with a part of the surface, which defines the concave portion 18, of the head main body 10 (namely, the first face P1 and the second face P2). Preferably, the weight member 20 is provided with two abutting surfaces T1 and T2 so as to be able to contact with the first face P1 and the second face P2, respectively. Thereby, the position of the weight member 20 relative to the head main body 10 is stabilized.

The above-mentioned fixing member 30 is fixed to the concave portion 18 so that at least a part of the weight member 20 is covered with the fixing member 30 from the outside of the golf club head.

The fixing member 30 in this embodiment is provided with an inside shape which substantially corresponds with an outside shape of an outer face T3 of the weight member 20 which faces toward the outside of the golf club head (in other words, they are substantially complementary shapes).

Thereby, by fixing the fixing member 30 to the head main body 10, the weight member 20 is immovably secured between the head main body 10 and the fixing member 30, and the position of the weight member 20 is uniquely determined.

Thus, in the golf club head 1 in this embodiment, by only fixing the fixing member 30 to the head main body 10, the weight member 20 can be fixed to the head main body 10, therefore, it is unnecessary for the weight member 20 to be welded with the head main body 10 or to be fixed to the fixing member 30 in advance as in the above-mentioned Patent Documents.

Therefor, the golf club head 1 in this embodiment is easy to manufacture and can provide excellent productivity. Further, since a part of the weight member 20 is covered with the fixing member 30 from outside of the golf club head, the weight member 20 is difficult to come off the head main body 10, thus excellent durability can be obtained.

The fixing member 30 is provided with a through hole 32. The through hole 32 is a space penetrating the fixing member 30, and one end of the through hole 32 is opened in the outer surface having the finished shape, of the fixing member 30 to define an opening 34. In other words, the opening 34 is located in the outer surface of the head having the finished shape. The other end of the through hole 32 is opened within the concave portion 18.

In the through hole 32, a part of the weight member 20 is disposed. By such arrangement, the center of gravity of the golf club head 1 can be positioned closer to the opening 34 of the through hole 32. Therefore, by providing the opening 34 in a desired position, the position of the center of gravity of the head can be controlled, and the degree of freedom in designing the center of gravity of the head is increased.

According to the present invention, the through hole 32 and the opening 34 may have various shapes.

In this embodiment, the through hole 32 and the opening 34 each have a horizontally long shape which is longer in the toe-heel direction than in the up-down direction.

The through hole 32 may be configured to have a cross-sectional shape which is variable or constant from the outer end to the inner end of the through hole 32.

Figure 5:
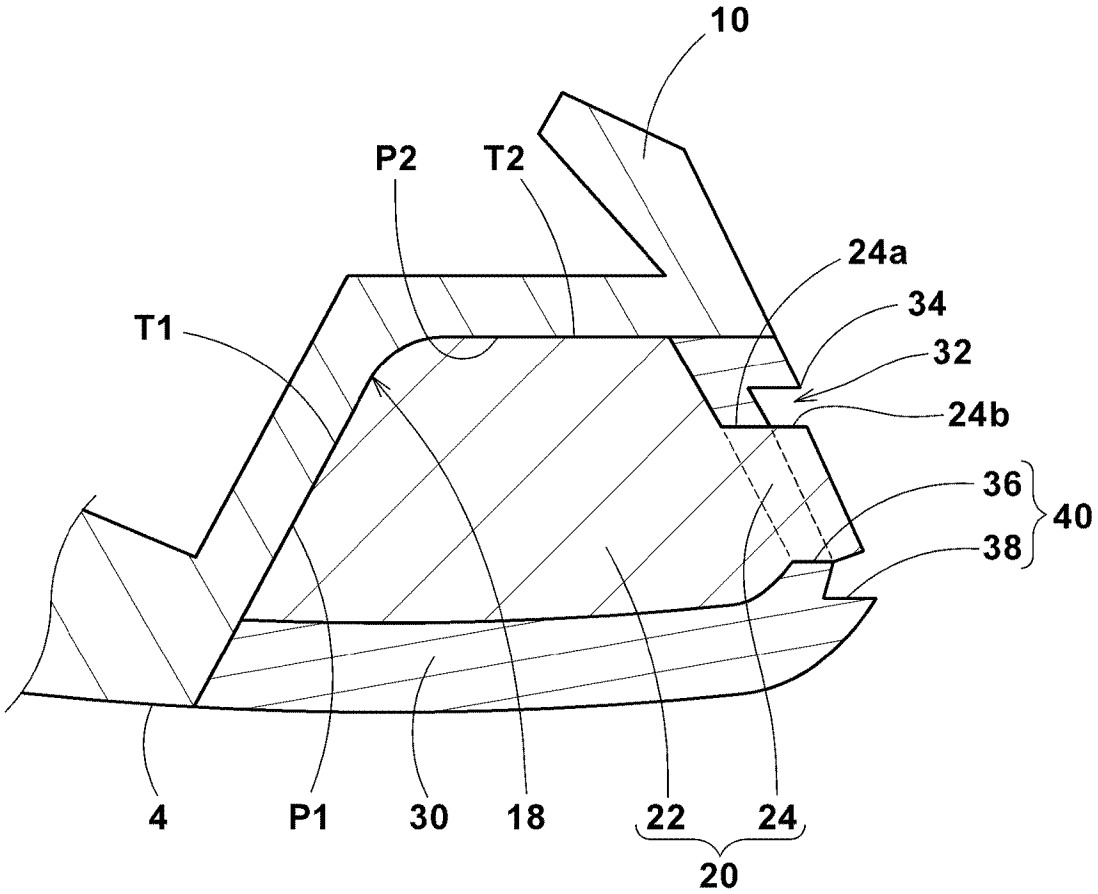
FIG. 5 is a closeup of FIG. 3(B) showing the weight member.

FIG. 5 is a cross sectional view of the through hole 32 taken along a plane orthogonal to the above-mentioned horizontal plane HP and the vertical plane VP. As shown, the through hole 32 becomes larger toward the outside of the golf club head.

The through hole 32 in this embodiment comprises an inside small part and an outside large part, therefore, an inner circumferential surface 40 of the through hole 32 comprises a first inner circumferential surface 36 of the inside small part located toward the inside of the golf club head, and a second inner circumferential surface 38 of the outside large part located toward the outside of the golf club head. In other words, when viewed from the outside of the head, the shape of the outside large part defined as being surrounded by the second inner circumferential surface 38 is larger than the shape of the inside small part defined as being surrounded by the first inner circumferential surface 36.

The first inner circumferential surface 36 and the second inner circumferential surface 38 are connected through a stepped surface facing toward the outside of the head.

In this embodiment, the weight member 20 comprises a main portion 22 covered inside the fixing member 30, and a protruding portion 24 protruding from the main portion 22 and disposed in the through hole 32.

Preferably, the protruding portion 24 is provided with a first surface 24*a* which is positioned when coming into contact with the first inner circumferential surface 36 of the through hole 32. By the contact therebetween, the weight member 20 can be fixed to the head main body 10 more firmly. Thereby, the rattling of the weight member 20 when striking a golf ball can be prevented, and the durability is improved.

In this embodiment, the first surface 24*a* and the first inner circumferential surface 36 contact with each other continuously in the circumferential direction of the surface 36, and their contact is annular and continuous. Thereby, the weight member 20 can be fixed more securely to the head main body 10 although it is not fixed directly to the head main body 10. Further, in order to increase the above effect, it is preferred that the protruding portion 24 is provided in its part on the inside of the head with the first surface 24*a* as in this embodiment.

Preferably, the protruding portion 24 is, in addition to the first surface 24*a*, provided with a second surface 24*b* not contacting with the inner circumferential surface 40 of the through hole 32 as in this embodiment. As a result, in this embodiment, an annular space is formed between the second surface 24*b* and the above-mentioned second inner circumferential surface 38 of the through hole 32. Such annular space can improve the workability in putting the protruding portion 24 of the weight member 20 into the through hole 32 of the fixing member 30, and it is helpful in improving the productivity.

In the golf club head 1 in this embodiment, the protruding portion 24 of the weight member 20 terminates at a position so as not to extend beyond the opening 34 of the fixing member 30 (i.e. a position not outside an imaginary opening plane defined by the edge of the opening 3). Thereby, the protruding portion 24 does not interfere with polishing operation of the back face 9, etc., and the polishing operation can be conducted efficiently.

Figure 6:
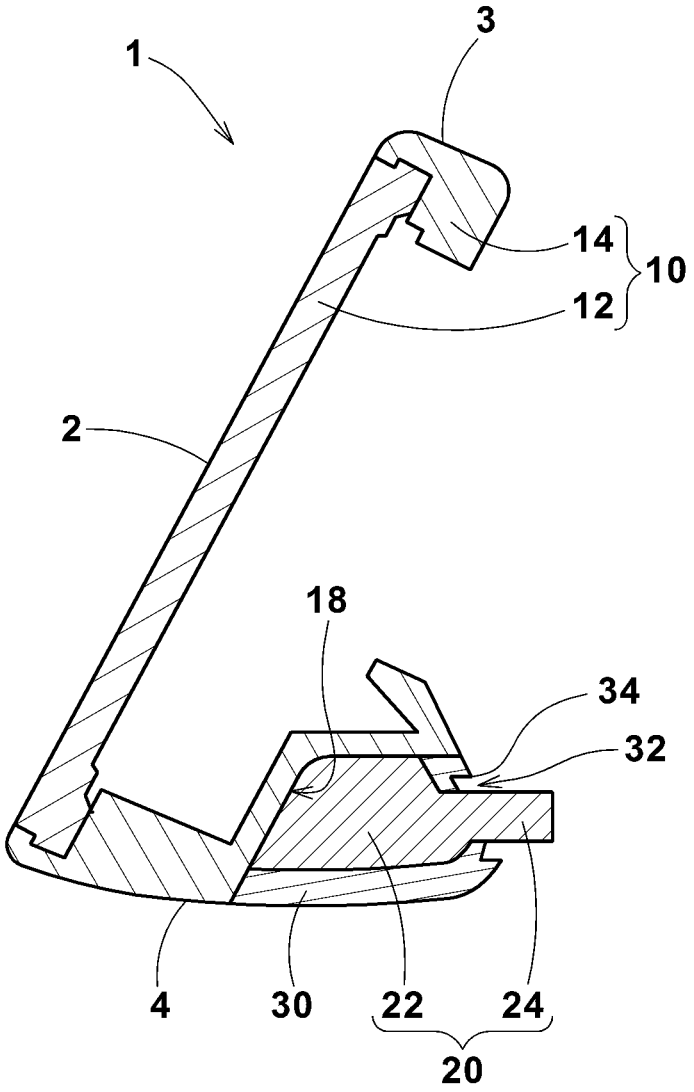
FIG. 6 is a vertical cross-sectional view of a golf club head as another embodiment of the present invention.

However, according to the present invention, the protruding portion 24 of the weight member 20 can protrude outside from the opening 34 of the fixing member 30 as shown in FIG. 6 which shows another embodiment of the present invention. The protruding portion 24 extending backward of the head beyond the opening 34 can allocate more weight both on the sole side and on the back side of the golf club head, therefore, it is possible to provide the golf club head whose center of gravity is low and deep.

In the embodiment shown in FIG. 6, the fixing member 30 is made of an alloy comprising tungsten, nickel and iron for example as with the weight member 20.

Therefore, as explained above, it is relatively easy to adjust the specific gravity of the fixing member 30.

It is preferable that, in comparison with the weight member 20, the fixing member 30 has a smaller content of tungsten and a larger content of iron in terms of weight percentage so that the fixing member 30 has a lower specific gravity than the weight member 20.

The specific gravity of the fixing member 30 is preferably set in a range from 8 to 10.

In the golf club head 1 in this embodiment, the weight member 20 has the largest specific gravity, the head main body 10 has the smallest specific gravity, and the fixing member 30 has the specific gravity therebetween. Thus, not only the weight member 20 but also the fixing member 30 can be used as the weight utilizable in designing the center of gravity.

Further, in comparison with the weight member 20, as the fixing member 30 has a smaller tungsten content and a larger iron content in terms of weight percentage, it is excel in the weldability (bond strength of a welded joint) with the head main body 10 made of an iron-based alloy. Thus, the fixing member 30 can be fixed to the head main body easily by welding.

In the embodiments shown in FIGS. 1 through 6, the opening 34 of the fixing member 30 is provide on the back face 9 side of the golf club head. Accordingly, a part of the weight member 20 extends backward through the through hole 32 and can be positioned on the back face 9 side of the major part of the weight member 20 covered with the fixing member 30. Such golf club head 1 can provide its center of gravity positioned more backward.

Further embodiments of the present invention will be described below in conjunction with FIGS. 7 through 13, it must be noted that the same reference numbers are used for the same or corresponding elements as in the previous embodiments and the descriptions thereof are omitted.

Figure 7:
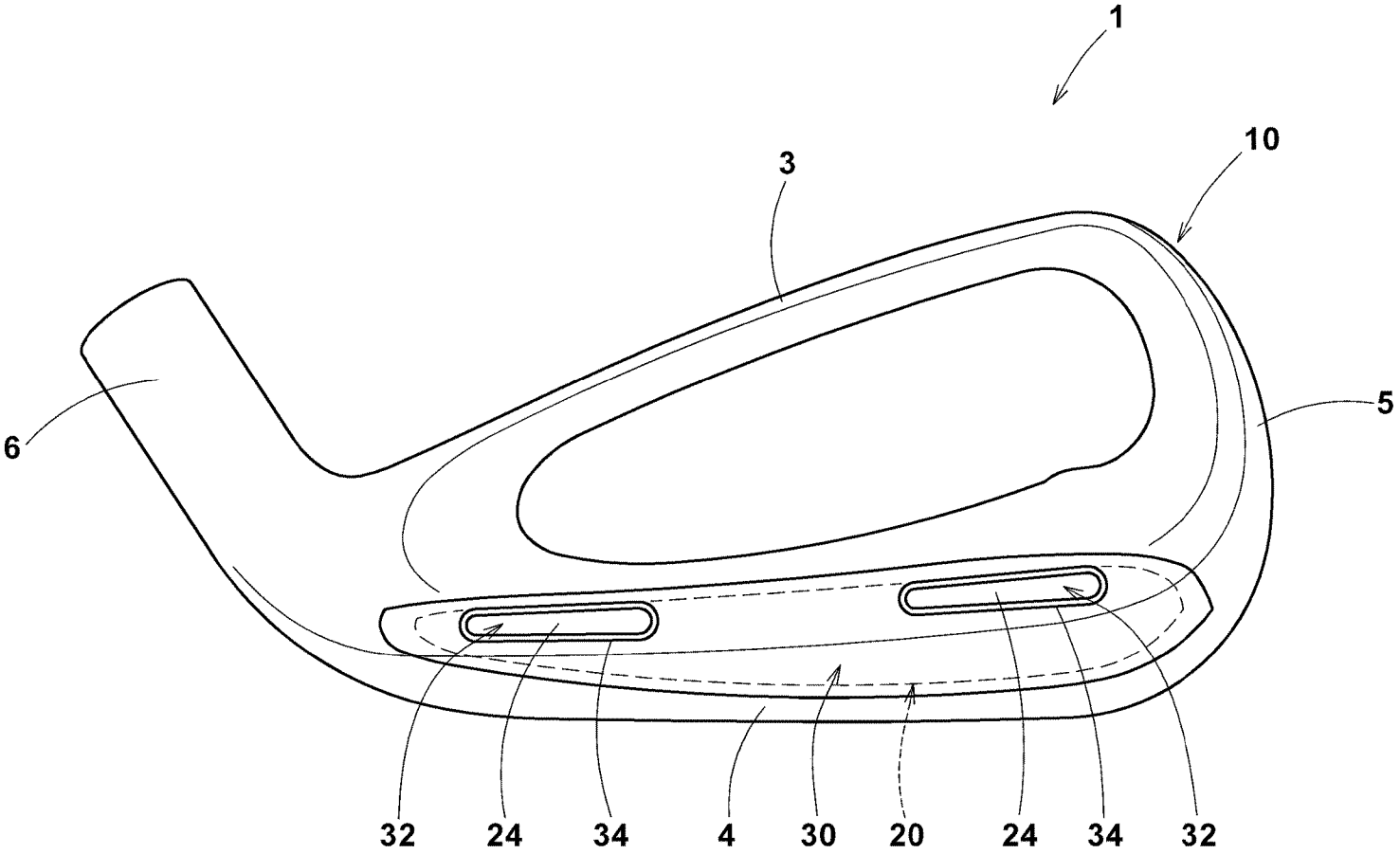
FIG. 7 is a rear view of a golf club head as another embodiment of the present invention.

FIG. 7 shows a rear view of the golf club head 1 in its forward tilted state as another embodiment of the present invention, in which the fixing member 30 is provided with a plurality of the openings 34, and the weight member 20 is provided with a plurality of the protruding portions 24 corresponding thereto.

The protruding portions 24 are respectively disposed in toe side and heel side of the weight member 20, and the openings 34 are respectively disposed in toe side and heel side of the fixing member 30. As a result, it is possible to allocate more weight on the backside of the head on the toe side and the heel side. Thereby, it is possible to increase the moment of inertia around a vertical axis passing through the center of gravity of the golf club head while providing the deep center of gravity.

Figure 8:
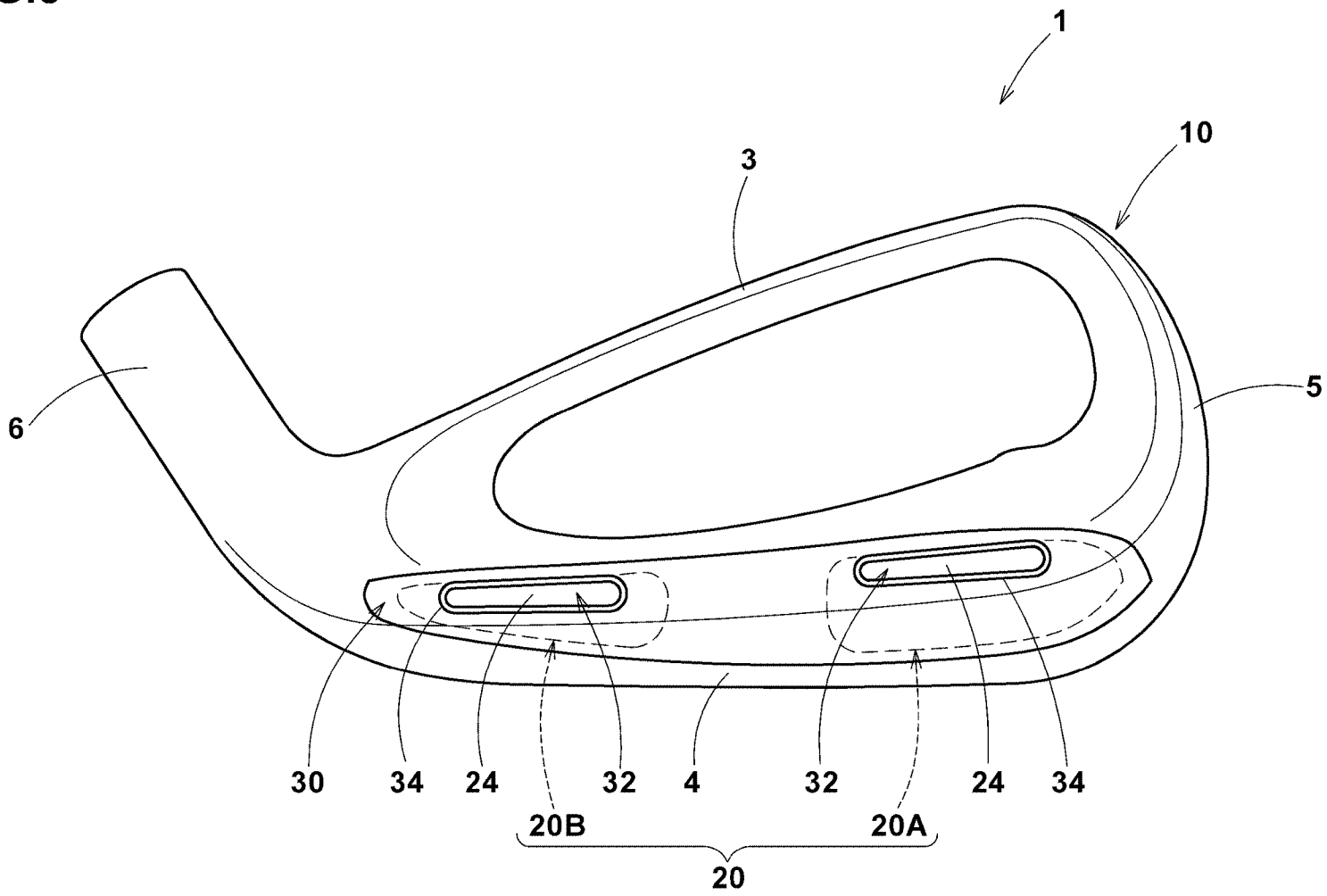
FIG. 8 is a rear view of a golf club head as another embodiment of the present invention.

FIG. 8 shows a rear view of the golf club head 1 in its forward tilted state as yet another embodiment of the present invention, which is a modification of the golf club head 1 shown in FIG. 7, wherein the weight member 20 is divided into a weight member 20A disposed on the toe side and a weight member 20B disposed on the heel side. In this case, it is possible to allocate more weight on the backside of the head and intensively on the toe side and the heel side of the head. Thereby, it is possible to increase the moment of inertia around a vertical axis which passes through the center of gravity of the golf club head while providing the deep center of gravity.

In the embodiment shown in FIG. 8, the weight member 20A on the toe side and the weight member 20B on the heel side are fixed by the single fixing member 30, but the fixing member 30 may be configured as separate pieces (not shown) for fixing the weight members 20A and 20B, respectively.

Figure 9:
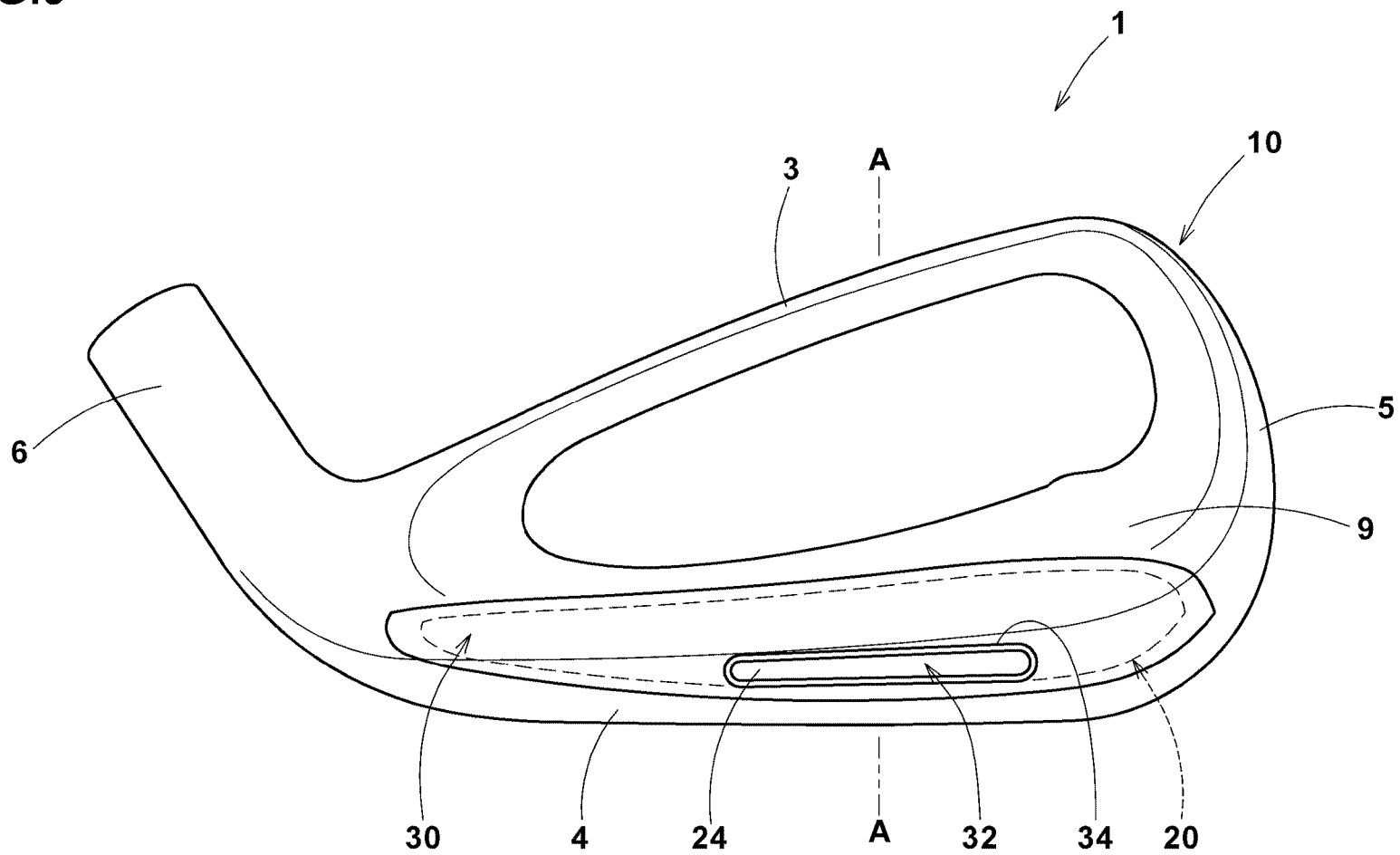
FIG. 9 is a rear view of a golf club head as another embodiment of the present invention.
Figure 10:
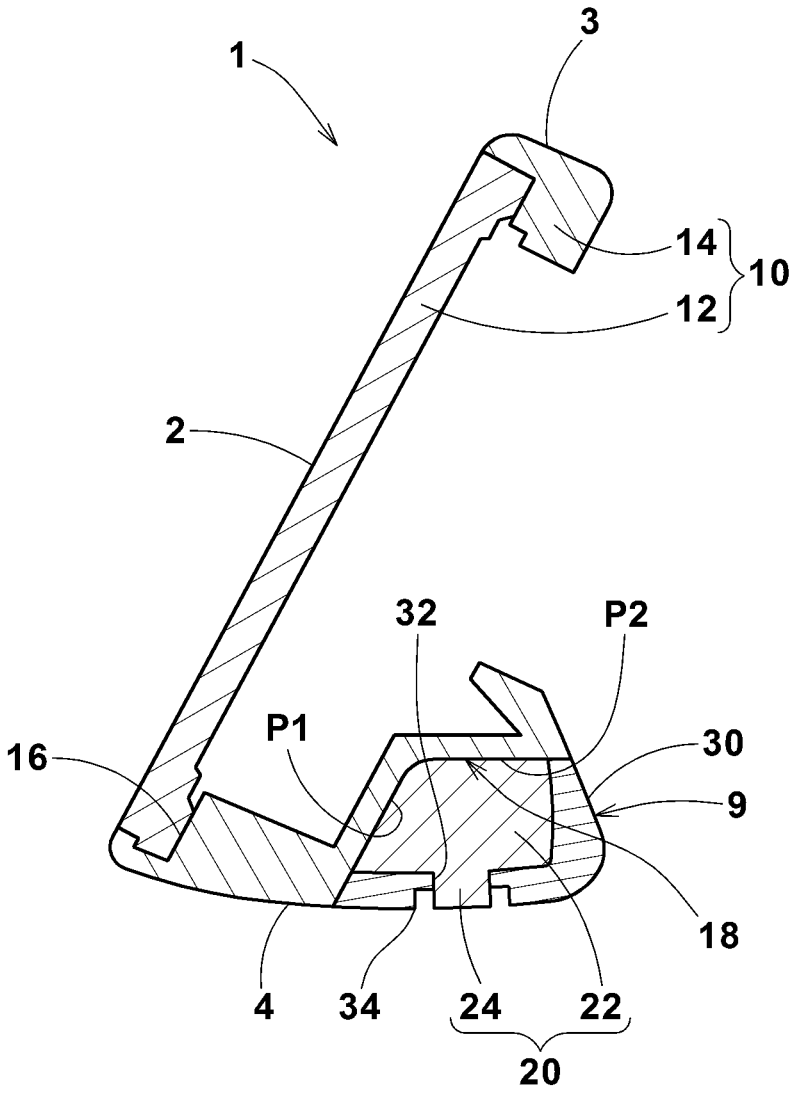
FIG. 10 is a vertical cross-sectional view of the golf club head shown in FIG. 9 under its standard state taken along line A-A in FIG. 9.

FIG. 9 is a rear view of the golf club head 1 as yet another embodiment of the present invention in its forward tilted state. FIG. 10 is a cross sectional view taken along line A-A in FIG. 9. As shown, the single through hole 32 and the single opening 34 of the fixing member 30 are provided in the sole 4, and the through hole 32 extends in the vertical direction of the golf club head in the standard state.

And the protruding portion 24 of the weight member 20 extends downward of the golf club head to be positioned in the through hole 32. In this case, even if the weight member has a large specific gravity and cannot be welded with the head main body, a part of the weight member can be disposed in the sole 4, therefore, it is possible to provide the golf club head with the center of gravity whose position is further lowered.

Figure 11:
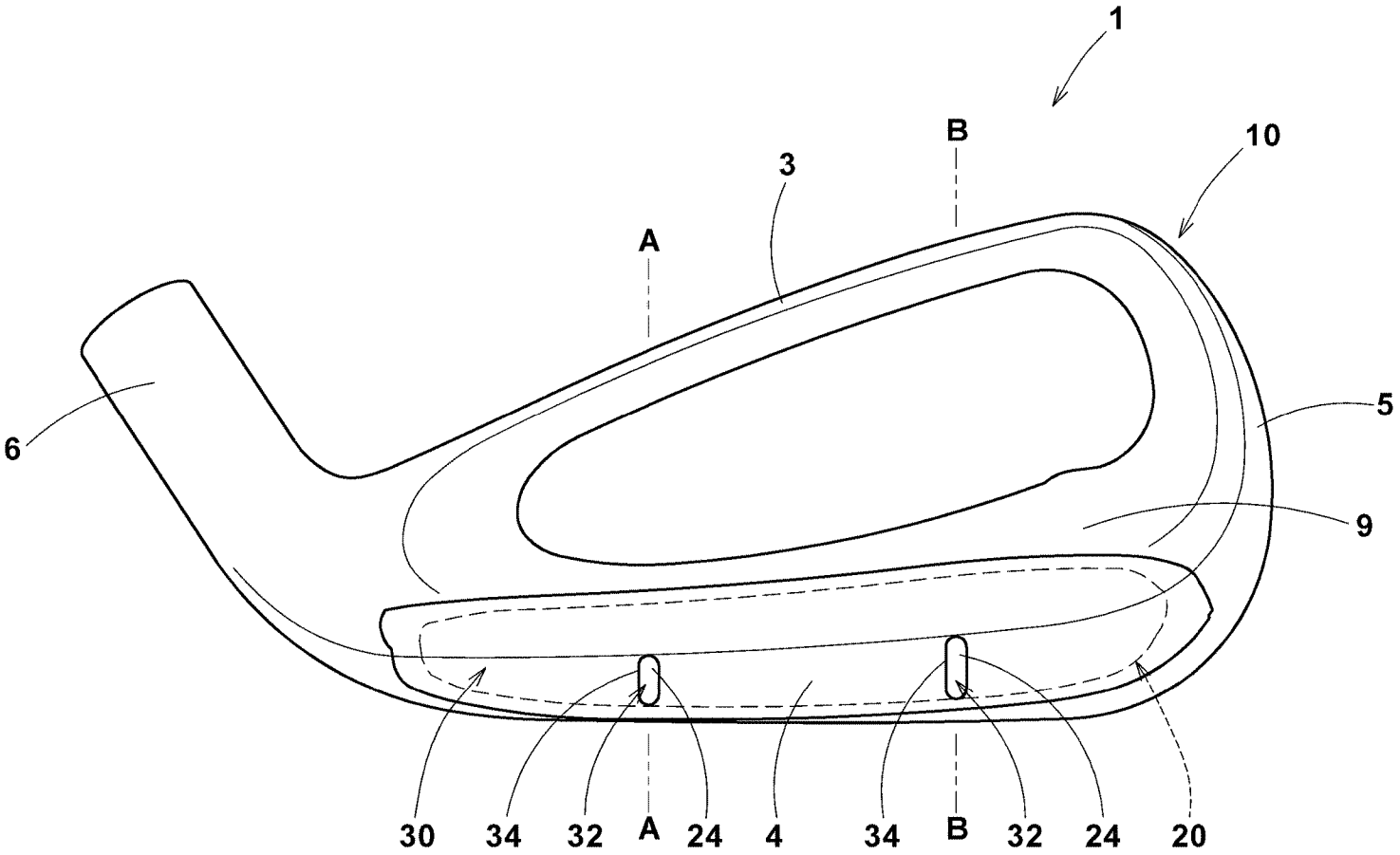
FIG. 11 is a rear view of a golf club head as another embodiment of the present invention.
Figure 12B:
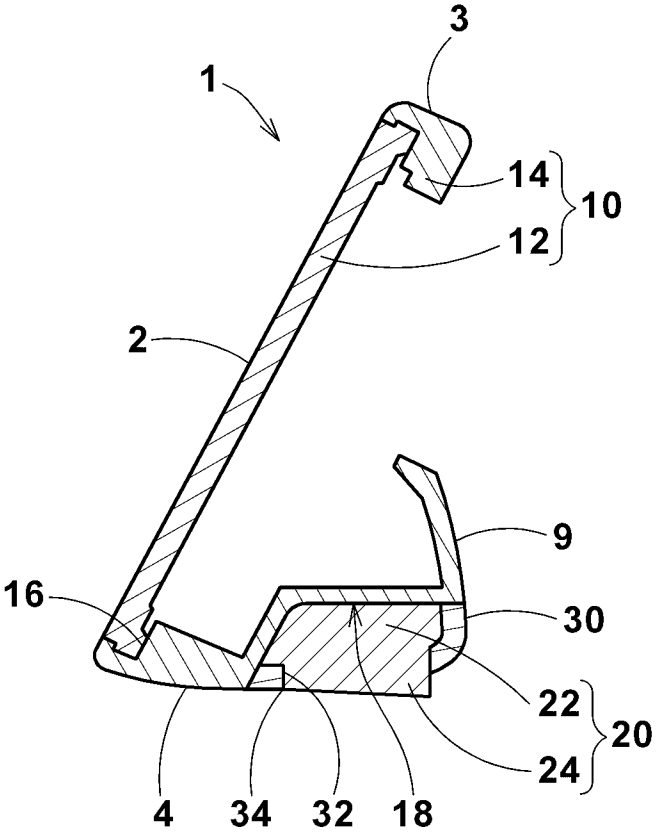
FIGS. 12(A) and 12(B) are vertical cross-sectional views of the golf club head shown in FIG. 11 under its standard state taken along line A-A and line B-B, respectively, in FIG. 11.
Figure 12A:
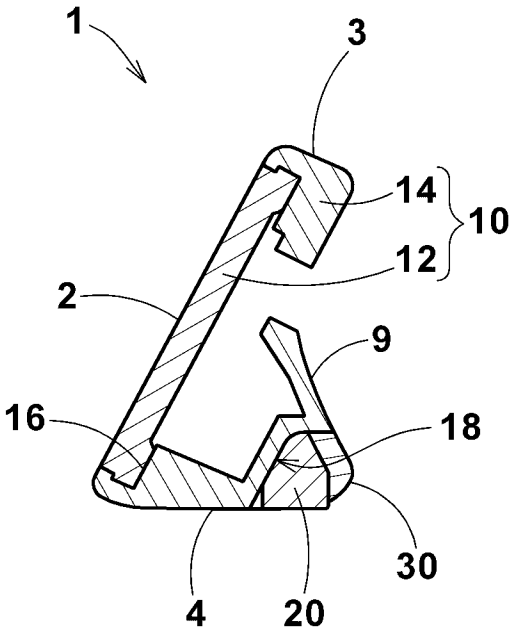

FIG. 11 is a rear view of the golf club head 1 in its forward tilted state as yet another embodiment of the present invention. FIGS. 12A and 12B are cross sectional views taken along line A-A and line B-B, respectively, of FIG. 11. As shown, the openings 34 of the fixing member 30 are disposed in the sole 4, and extend in the front-back direction of the head. The openings 34 are provided in toe side and heel side of the fixing member 30.

The protruding portions 24 of the weight member 20 partially project to the outside of the fixing member 30 from the respective openings 34, and their projecting parts extend in the front-back direction of the golf club head. Such weight member 20 can provide weight in a lower part of the golf club head 1 to provide the golf club head with the center of gravity whose position is further lowered. Further, the projecting parts of the protruding portions 24 function as a guide when a player swings the golf club and the sole 4 touches the ground, therefore, it is possible that the sole 4 slides smoothly on the ground.

Figure 13:
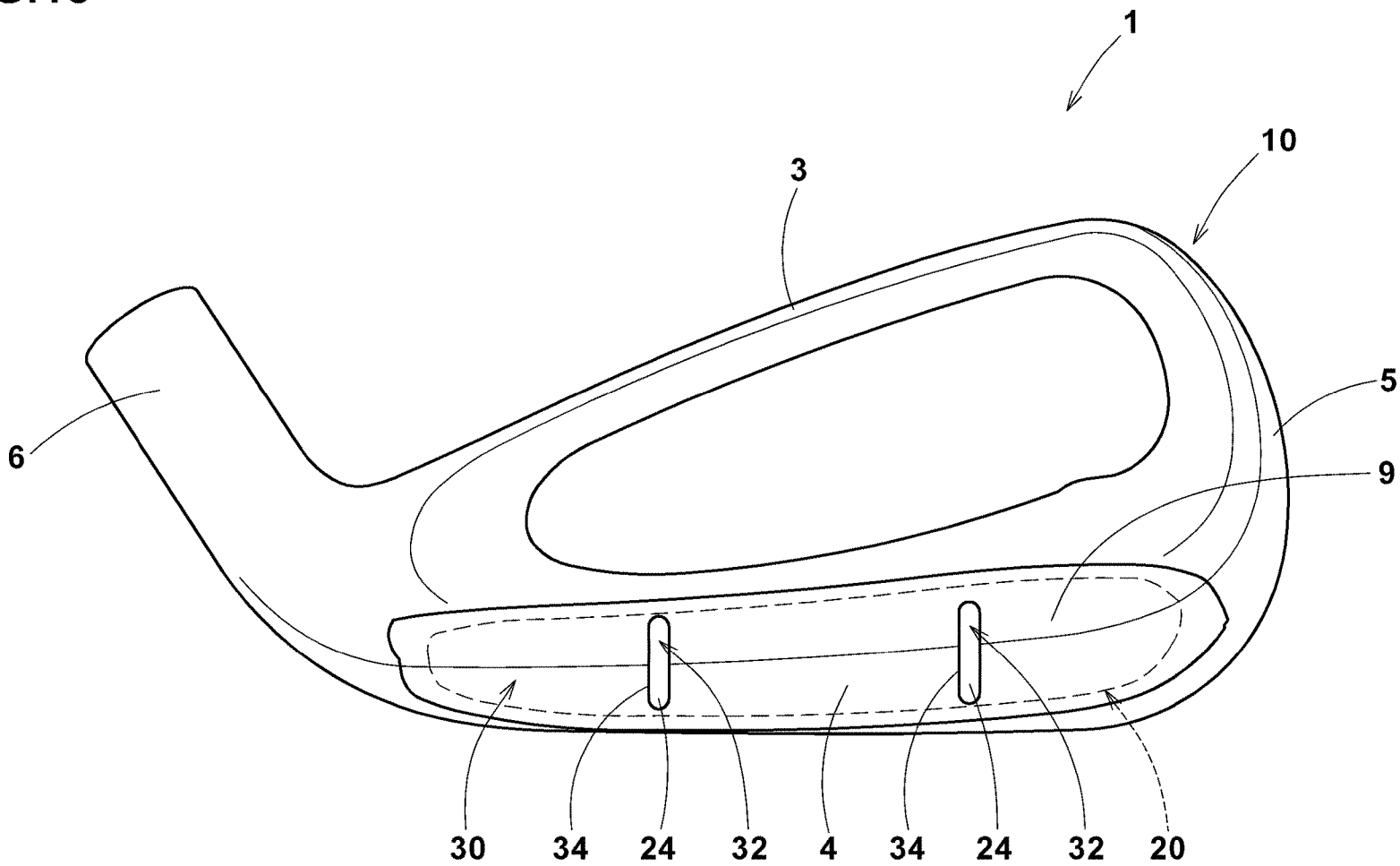
FIG. 13 is a rear view of a golf club head as another embodiment of the present invention.

FIG. 13 shows a rear view of the golf club head 1 in its forward tilted state as yet another embodiment of the present invention, wherein the openings 34 of the fixing member 30 extend between the sole 4 and the back face 9 of the golf club head 1. In this case, it is possible to allocate the weight to the back face 9 side and the sole 4 side of the head in a good balance While detailed description has been made of preferable embodiments of the present invention, the present invention can be embodied in various forms without being limited to the illustrated specific embodiments. Especially, the characteristic feature(s) of any one of the embodiments may be combined with another embodiment or may be replaced by the characteristic feature(s) of another embodiment.

REFERENCE SIGNS LIST

1 golf club head
10 head main body
18 concave portion
20, 20A, 20B weight member
30 fixing member
32 through hole
34 opening

The invention claimed is:

1. A golf club head comprising a head main body, a weight member and a fixing member, wherein:

a specific gravity of the weight member is larger than a specific gravity of the head main body and larger than a specific gravity of the fixing member, the head main body is provided in its outer surface with a concave portion, the weight member is disposed in the concave portion so that a part of the outer surface of the weight member fits to the concave portion, the fixing member is fixed to the concave portion from outside of the golf club head so that a part of said outer surface of the weight member is covered with the fixing member, the fixing member is provided with a through hole having an opening located in the outer surface of the fixing member, and a part of the weight member protrudes into the through hole.

2. The golf club head according to claim 1, wherein with respect to specific gravities, the head main body is the smallest, the weight member is the largest, and the fixing member is therebetween.

3. The golf club head according to claim 1, wherein the head main body has a better weldability with the fixing member than with the weight member, and the fixing member and the head main body are fixed to each other by welding.

4. The golf club head according to claim 1, wherein said opening of the fixing member is provided in a back side of the golf club head.

5. The golf club head according to claim 1, wherein said opening of the fixing member is provided in a sole of the golf club head.

6. The golf club head according to claim 1, wherein said opening of the fixing member is provided in at least one of a toe side part and a heel side part of the golf club head.

7. The golf club head according to claim 1, wherein the weight member is disposed in a toe side part or alternatively a heel side part of the golf club head.

8. The golf club head according to claim 1, wherein the weight member is disposed in each of a toe side part and a heel side part of the golf club head separately.

9. The golf club head according to claim 1, wherein said part of the weight member protruding into the through hole protrudes out of the fixing member from the opening.

10. The golf club head according to claim 5, wherein said opening has a shape elongated in a front-back direction of the golf club head, and the weight member protrudes out of the fixing member from said opening so that the protruding part extends in the front-back direction.

11. The golf club head according to claim 1, wherein the outer surface of the fixing member excepting said opening forms a part of the outer surface of the head, and between an inner surface of the fixing member and the concave portion a space accommodating the weight member is formed.

12. The golf club head according to claim 4, wherein said opening has a shape elongated in a toe-heel direction of the golf club head.

13. The golf club head according to claim 12, wherein the weight member protrudes out of the fixing member from said opening so that the protruding part extends in the toe-heel direction.

14. The golf club head according to claim 5, wherein said opening has a shape elongated in a toe-heel direction of the golf club head.

15. The golf club head according to claim 1, wherein said opening has a shape elongated in a front-back direction of the golf club head and the opening extends from a back side to a sole side of the golf club head.

16. The golf club head according to claim 3, wherein each of the weight member and the fixing member is made of an alloy comprising tungsten, nickel and iron, and the alloy of the fixing member has a less content of tungsten and a more content of iron in terms of percentage than the alloy of the weight member.

17. The golf club head according to claim 1, wherein the head main body comprises a face plate and a face plate support to which a peripheral portion of the face plate is fixed, said concave portion is provided on the face plate support, the face plate is made of a titanium alloy, and the face plate support is made of an iron-based alloy.

18. The golf club head according to claim 17, wherein, each of the weight member and the fixing member is made of an alloy comprising tungsten, nickel and iron, and the alloy of the fixing member has a less content of tungsten and a more content of iron in terms of percentage than the alloy of the weight member.

19. The golf club head according to claim 1, wherein the head main body comprises a face plate and a face plate support to which a peripheral portion of the face plate is fixed, said concave portion is provided on the face plate support, the specific gravity of the face plate is not greater than 4.5, the specific gravity of the face plate support is not less than 7.0, the specific gravity of the weight member is not less than 10 and not greater than 18.5, and the specific gravity of the fixing member is not less than 8 and not greater than 10.

20. A golf club head comprising:

a head main body provided with a hollow having an opening in a rear and lower part of the head main body, a covering member provided with a through hole and closing the opening substantially such that the through hole communicates between the inside and outside of the hollow; and a weight member having a protruding part and disposed in the hollow so that the protruding part of the weight member protrudes into the through hole, wherein:

the through hole extends backward and/or downward of the head from the hollow, and the covering member is welded with the head main body, but the weight member is not welded with the head main body.

* * * * *